US006497612B2

(12) United States Patent
Brunelli

(10) Patent No.: US 6,497,612 B2
(45) Date of Patent: Dec. 24, 2002

(54) SYSTEM AND METHOD FOR REDUCING SURFACE DEFECTS IN INTEGRATED CIRCUITS

(75) Inventor: Thad L. Brunelli, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/117,883

(22) Filed: Apr. 8, 2002

(65) Prior Publication Data

US 2002/0115388 A1 Aug. 22, 2002

Related U.S. Application Data

(62) Division of application No. 09/258,744, filed on Feb. 26, 1999, now Pat. No. 6,375,544.

(51) Int. Cl.[7] ..... B24B 1/00

(52) U.S. Cl. ..... 451/36; 451/41; 451/54; 451/60; 451/63

(58) Field of Search ..... 451/41, 36, 37, 451/54, 60, 63, 57, 285, 287, 288, 446

(56) References Cited

U.S. PATENT DOCUMENTS

| | | | | |
|---|---|---|---|---|
| 5,227,001 | A | 7/1993 | Tamaki et al. | 156/345 |
| RE34,425 | E | 11/1993 | Schultz | 51/165.74 |
| 5,486,129 | A | 1/1996 | Sandhu et al. | 451/5 |
| 5,514,245 | A | 5/1996 | Doan et al. | 156/636.1 |
| 5,563,709 | A | 10/1996 | Poultney | 356/371 |
| 5,643,060 | A | 7/1997 | Sandhu et al. | 451/285 |
| 5,643,061 | A | 7/1997 | Jackson et al. | 451/289 |
| 5,658,183 | A | 8/1997 | Sandhu et al. | 451/5 |
| 5,664,990 | A | 9/1997 | Adams et al. | 451/60 |
| 5,679,169 | A | 10/1997 | Gonzales et al. | 134/1.3 |
| 5,700,180 | A | 12/1997 | Sandhu et al. | 451/5 |
| 5,702,292 | A | 12/1997 | Brunelli et al. | 451/41 |
| 5,730,642 | A | 3/1998 | Sandhu et al. | 451/6 |

(List continued on next page.)

OTHER PUBLICATIONS

"The World's Most Popular, Fully Automated CMP Tool", *IPEC Planar,* CMP Equipment, Avanti 472 at http://207.108.158.32/planar/472.html, 1–4, (Feb. 8, 1999).

Blatt, C., et al., "Integrated CMP and Post–CMP Cleaning Cluster Particle Removal with DI Water", *IPEC Planar,* Process Paper at http://www.ipec.com/planar/paper2.html, 1–6, (Jul. 9, 1998).

Holland, K., et al., "Planarization by CMP for ULSI Applications", *IPEC Planar, Process Technology,* Process Paper at http://www.ipec.com/planar/paperl.html, 1–6, (Jul. 9, 1998).

(List continued on next page.)

(57) ABSTRACT

The fabrication of integrated circuits entails the repeated application of many basic processing steps, for instance, planarization—the process of making a surface flat, or planar. One specific technique for making surfaces flat is chemical-mechanical planarization, which typically entails applying slurry onto a surface of an integrated circuit and polishing the surface with a rotating polishing head. The head includes several holes, known as slurry dispensers, through which slurry is applied to the surface. After completion of a polishing operation, gas is forced through the slurry dispensers to separate the surface from the rotating head. Unfortunately, the gas dries slurry remaining on the surface, causing slurry particles to stick to the polished surface, which ultimately cause defects in integrated circuits. Accordingly, the inventor devised a new method of polishing that applies a polishing head to a surface, dispenses slurry through a slurry dispenser in the polishing head onto the surface, polishes the surface, and then dispenses a substantially particulate-free liquid through the slurry dispenser to facilitate separation of the polishing head and the surface and thereby avoid drying slurry on the surface.

34 Claims, 2 Drawing Sheets

U.S. PATENT DOCUMENTS

| | | | | |
|---|---|---|---|---|
| 5,738,567 | A | 4/1998 | Manzonie et al. | 451/41 |
| 5,762,537 | A | 6/1998 | Sandhu et al. | 451/7 |
| 5,816,900 | A | 10/1998 | Nagahara et al. | 451/285 |
| 5,842,909 | A | 12/1998 | Sandhu et al. | 451/7 |
| 5,851,135 | A | 12/1998 | Sandhu et al. | 451/5 |
| 5,894,852 | A | 4/1999 | Gonzales et al. | 134/1.3 |
| 5,895,550 | A | 4/1999 | Andreas | 156/345 |

OTHER PUBLICATIONS

IPEC, "Introducing the AvantGaard 676", *IPEC Planar,* CMP Equipment, AvantGaard 676 at http://207.108.158.32/planar/676.html, 1–8, (Feb. 8, 1999).

IPEC, "Introducing the AvantGaard 776, The World's Most Advanced CMP Technology", *IPEC Planar,* CMP Equipment, AvantGaard 776 at http://207.108.158.32/planar/776.html, 1–13, (Feb. 8, 1999).

Parikh, P.J., "Chemical Mechanical Planarization: An Analysis of Variables", *IPEC Planar,* http://ipec.com/planar/paper3.html, 1–9, (Jul. 9, 1998).

*Primary Examiner*—Eileen P. Morgan
(74) *Attorney, Agent, or Firm*—Schwegman, Lundberg, Woessner & Kluth, P.A.

SYSTEM AND METHOD FOR REDUCING SURFACE DEFECTS IN INTEGRATED CIRCUITS

RELATED APPLICATIONS

This application is a Divisional of U.S. Ser. No. 09/258,744 filed on Feb. 26, 1999, now U.S. Pat. No. 6,375,544 which is incorporated herein by reference.

TECHNICAL FIELD

The present invention concerns methods of making integrated circuits, particularly methods of polishing or planarizing surfaces.

BACKGROUND OF THE INVENTION

Integrated circuits, the key components in thousands of electronic and computer products, are interconnected networks of electrical components fabricated on a common foundation, or substrate. Fabricators typically build the circuits layer by layer, using techniques, such as doping, masking, and etching, to form thousands and even millions of microscopic resistors, transistors, and other electrical components on a silicon substrate, known as a wafer. The components are then wired, or interconnected, together to define a specific electric circuit, such as a computer memory.

One important concern during fabrication is flatness, or planarity, of various layers of the integrated circuit. For example, planarity significantly affects the accuracy of a photo-imaging process, known as photomasking or photolithography, which entails focusing light on light-sensitive materials to define specific patterns or structures in a layer of an integrated circuit. In this process, the presence of hills and valleys in a layer means that various regions of the layer will be in or out of focus and that certain resulting structural features in the layer will be smaller or larger than intended. Moreover, hills and valleys can reflect light undesirably onto other regions of a layer and add undesirable features, such as notches, to desired features. These problems can be largely avoided if the layer is sufficiently planar.

One process for making surfaces flat or planar is known as chemical-mechanical planarization or polishing. Chemical-mechanical planarization, often called CMP for short, typically entails applying a fluid containing abrasive particles to a surface of an integrated circuit, and polishing the surface with a rotating polishing head. (In some instances, both the surface and the polishing head rotate.) The mixture of the fluid and abrasive particles is known as a slurry. The polishing head typically includes several holes, known as slurry dispensers, which dispense the slurry onto the surface during polishing. After polishing, a gas, such as air or nitrogen, is forced through the slurry dispensers to facilitate separation of the polished surface from the polishing head.

One problem that the inventor recognized with this planarization method is that forcing air or nitrogen through slurry dispensers immediately after polishing occasionally dries slurry on the polished surface, causing particles in the slurry to stick to the polished surface. Although the polished surface is sometimes rinsed following the polishing process, some of the particles remain on the polished surface as defects. Accordingly, there is a need for a chemical-mechanical planarization technique that reduces the chance of these defects.

SUMMARY OF THE INVENTION

To address these and other needs, the inventor devised a new method of polishing or planarization with the potential for reducing the chance of slurry particles (or particulates) adhering to polished surfaces and thus the chance of leaving defects on the polished surfaces. In particular, one embodiment of the method dispenses slurry through one or more slurry dispensers in the polishing head onto the surface, polishes the surface, and then dispenses a substantially particulate-free liquid through one or more of the slurry dispensers. Unlike gases, such as air and nitrogen, the substantially particulate-free liquid facilitates separation of the polishing head and the surface, without drying slurry on the surface. In an exemplary embodiment, the polishing head is part of a chemical-mechanical polishing machine, and the substantially-particulate-free liquid is deionized water.

DESCRIPTION OF THE PREFERRED EMBODIMENTS

Figure 1:
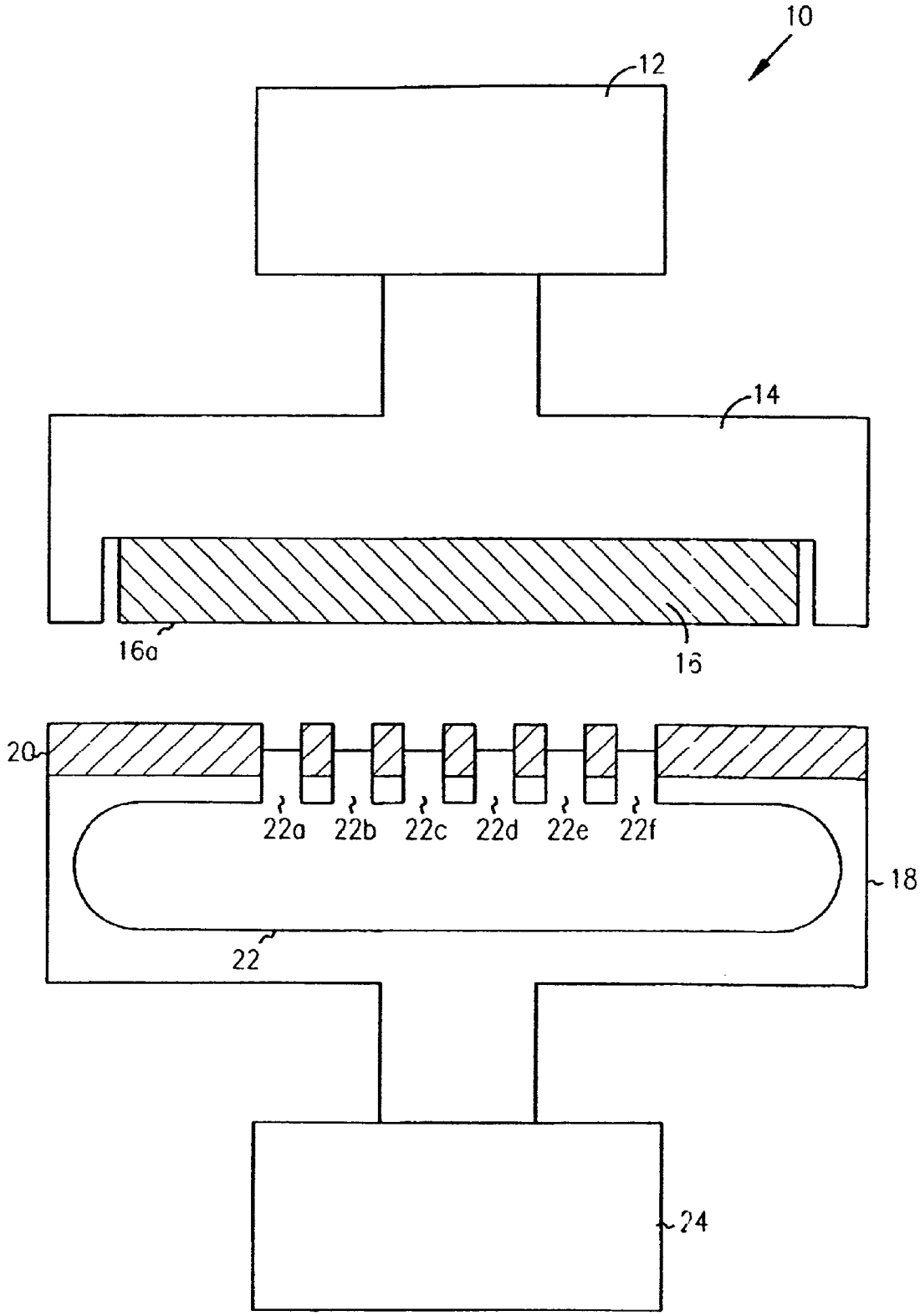
FIG. 1 is a cross-sectional view of an exemplary chemical-mechanical planarization machine 10.
Figure 2:
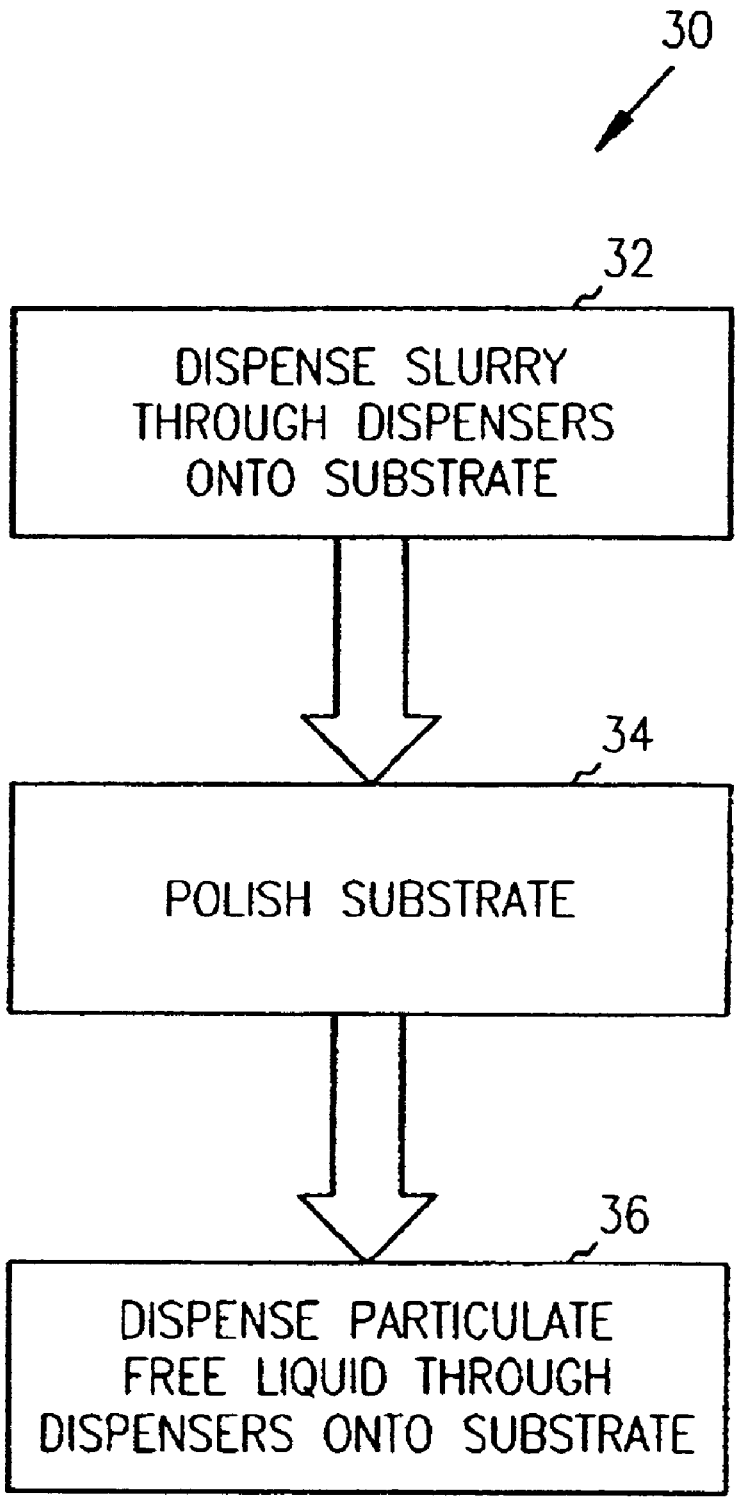
FIG. 2 is a flow chart illustrating the exemplary polishing method.

The following detailed description, which references and incorporates FIGS. 1 and 2, describes and illustrates specific embodiments of the invention. These embodiments, offered not to limit but only to exemplify and teach the invention, are shown and described in sufficient detail to enable those skilled in the art to implement or practice the invention. Thus, where appropriate to avoid obscuring the invention, the description may omit certain information known to those of skill in the art.

EXEMPLARY PLANARIZATION MACHINE

FIG. 1 shows an exemplary chemical-mechanical planarization or polishing (CMP) system or machine 10. Some embodiment of the invention uses various chemical-mechanical polishing machines from Integrated Process Equipment Corporation of Phoenix, Ariz., for example, the Avanti 472, the AvantGaard 676, and the AvantGaard 776. The owners manual of the AvantGaard 776 machine is incorporated herein by reference. Additionally, the invention can be incorporated into a Strauseagh 6DSP polisher. However, the present invention is not limited to any particular genus or specifies of chemical-mechanical planarization machine. Indeed, the invention can be applied to any processing tool having a carrier for carrying wafers.

In particular, exemplary machine 10 includes a variable-speed motor 12 coupled to a wafer carrier 14, which carries a wafer (or substrate) 16. The term "substrate," as used herein, encompasses a semiconductor wafer as well as structures having one or more insulative, semi-insulative, conductive, or semiconductive layers and materials. Thus, for example, the term embraces metals and non-metals, and silicon-on-insulator, silicon-on-sapphire, and other advanced structures. Moreover, in some embodiments of the invention, the substrate includes insulative layers with embedded metal lines or layers of diffusion barrier materials such as silicon nitride.

Substrate 16 includes a surface 16a which confronts polishing head 18. Polishing head 18 includes a polishing pad or surface 20 and a slurry bladder 22. (Polishing surface is sometimes called a platen.) Slurry bladder 22 includes a number of nipple-like slurry dispensers, of which dispensers 22*a*–22*f* are representative. Polishing head 18 is coupled to a motor 24 which rotates it at variable speeds about an axis different from the rotational axis of carrier 14.

Exemplary Method of Polishing or Planarizing

FIG. 2 shows the exemplary polishing method as a flowchart 30 comprising process blocks 32–36. In particular, block 32 shows that the exemplary method entails dispensing slurry through slurry dispenser 14 onto surface 22 of substrate 20. As used herein, the term "slurry" includes any fluid containing a substantial concentration of particulates. Various embodiments of the invention use silicon polish slurries, oxide polish slurries, and metal polish slurries, depending on the nature of the surface to be polished or planarized. Examples of particulates include silica ($SiO_2$), alumina ($Al_2O_3$), ceria ($Ce_2O_3$), and ferric nitrate ($Fe(NO_3)_3$), having diameters in the range of 20–1000 nanometers. Proportions of particles to liquid are 1–15% by weight in the exemplary embodiment. The invention, however, is not limited to any particular genus or species of slurry or any particular proportion of particulates.

As shown in process block 34, the exemplary method next applies polishing head 18, more precisely polishing surface 20, to surface 16*a* of substrate 16 and then begins polishing the surface. Once polishing ensues, it continues for an appropriate period of time, depending largely on the substrate composition, slurry composition, and rotational speeds of carrier 12 and head 18. During polishing, slurry is dispensed from slurry bladder 22 through slurry dispensers 22*a*–22*f* onto surfaces 16*a* and 20 as desired or necessary to achieve a desired level of planarity.

Process block 36 shows that the next step entails dispensing a substantially particulate-free liquid through one or more of slurry dispensers 22*a*–22*f* to facilitate separation of surface 16*a* and polishing surface 20. (In other embodiments, bladder 22 includes separate dispensers for dispensing the particulate-free liquid.) The exemplary embodiment uses a liquid which has less than a one percent concentration of particulates by weight. One example of such a liquid is deionized water. Some embodiments of the invention dispense a mild solvent or cleaning agent through the slurry dispensers, to not only facilitate separation of surface 16*a* and polishing surface 20, but also to clean both surfaces. The substrate can then be further processed to form an integrated circuit, for example, an integrated memory circuit, according to any desired process.

CONCLUSION

In furtherance of the art, the inventor has presented an improved method for planarizing surfaces. Unlike conventional chemical-mechanical planarization techniques that force air or nitrogen gas through slurry dispensers to facilitate separation of a polishing surface and a polished surface, one embodiment of the invention forces a substantially particulate-free liquid through the slurry dispensers to facilitate separation. As a result, this embodiment reduces the risk of slurry particulates drying on the polished surface and thus the occurrence of defects on the polished surfaces.

The embodiments described above are intended only to illustrate and teach one or more ways of practicing or implementing the present invention, not to restrict its breadth or scope. The actual scope of the invention, which embraces all ways of practicing or implementing the invention, is defined only by the following claims and their equivalents.

What is claimed is:

1. A method of making an integrated circuit, comprising:

dispensing slurry through one or more slurry dispensers of a polishing head onto a layer of the integrated circuit;

polishing the layer using the polishing head; and dispensing a liquid other than the slurry through one or more of the slurry dispensers onto the layer after polishing the layer to facilitate separation of the polishing head and the layer.

2. The method of claim 1, wherein the slurry has a concentration of particulates at least as great as one percent by weight and the liquid has a concentration of particulates which is less than one percent by weight.

3. The method of claim 1, wherein the slurry comprises a silicon polish slurry, an oxide polish slurry, or a metal polish slurry.

4. The method of claim 1, wherein the liquid comprises deionized water.

5. The method of claim 1, wherein the liquid comprises a cleaning agent.

6. The method of claim 1 wherein the slurry comprises particulates having diameters in the range of 20–1000 nanometers.

7. The method of claim 1 wherein the slurry comprises 1–15% particulates by weight.

8. The method of claim 1 wherein the slurry comprises silica, alumina, ceria, or ferric nitrate.

9. A method of polishing a surface in an integrated circuit assembly, comprising:

dispensing slurry through one or more slurry dispensers of a polishing head onto a surface in the integrated circuit assembly;

polishing the surface using the polishing head;

dispensing a liquid other than the slurry through one or more of the slurry dispensers onto the surface after polishing the surface to facilitate separation of the polishing head and the surface.

10. The method of claim 9, wherein the slurry has a concentration of particulates at least as great as one percent by weight and the liquid has a concentration of particulates which is less than one percent by weight.

11. The method of claim 9, wherein the slurry comprises a silicon polish slurry, an oxide polish slurry, or a metal polish slurry.

12. The method of claim 9 wherein the slurry comprises particulates having diameters in the range of 20–1000 nanometers.

13. The method of claim 9 wherein tie slurry comprises 1–15% particulates by weight.

14. The method of claim 9 wherein the slurry comprises silica, alumina, ceria, or ferric nitrate.

15. A method of operating a chemical-mechanical polishing machine having at least one polishing head, comprising:

dispensing a slurry through one or more orifices of the polishing head onto a surface;

polishing the surface using the polishing head; and dispensing a substantially particulate-free liquid through one or more orifices of the polishing head onto the polished surface to facilitate separation of the polishing head and the surface, wherein the substantially particulate-free liquid has a concentration of particulates which is less than one percent by weight.

16. The method of claim 15, wherein dispensing the substantially particulate-free liquid comprises dispensing at least some of the substantially particulate-free liquid through one or more of the orifices through which the slurry was dispensed.

17. The method of claim 15, wherein the slurry has a concentration of particulates at least as great as one percent by weight.

18. The method of claim 15, wherein the slurry comprises a silicon polish slurry, an oxide polish slurry, or a metal polish slurry.

19. The method of claim 15 wherein the slurry comprises particulates having diameters in the range of 20–1000 nanometers.

20. The method of claim 15 wherein the slurry comprises 1–15% particulates by weight.

21. The method of claim 15 wherein the slurry comprises silica, aluminas, ceria, or ferric nitrate.

22. Apparatus for polishing or planarizing a surface in an integrated circuit, comprising:

means for dispensing a slurry through one or more slurry dispensers of a polishing head onto the surface;

means for applying the polishing head to the surface; and means for dispensing a substantially particulate-free liquid through one or more of the slurry dispensers onto the surface to facilitate separation of the polishing head and the surface, wherein the substantially particulate-free liquid has a concentration of particulates which is less than one percent by weight.

23. The apparatus of claim 22, wherein the substantially particulate-free liquid has a concentration of particulates which is less than that of the slurry.

24. The apparatus of claim 22, wherein the means for dispensing the slurry comprises a bladder.

25. The apparatus of claim 22, wherein one or more of the slurry dispensers are nipple-like slurry dispensers.

26. The apparatus of claim 24, wherein the slurry has a concentration of particulates at least as great as one percent by weight and the substantially particulate-free liquid has a concentration of particulates which is less than one percent by weight.

27. Apparatus for polishing or planarizing a surface in an integrated circuit, comprising:

means, including a bladder, for dispensing a slurry through one or more slurry dispensers of a polishing head onto the surface;

means for polishing the surface using the polishing head; and means for dispensing a liquid other than the slurry through the slurry dispenser on the surface to facilitate separation of the polishing head and the surface.

28. The apparatus of claim 27, wherein the slurry has a concentration of particulates at least as great as one percent by weight and the substantially particulate-free liquid has a concentration of particulates which is less than one percent by weight.

29. The apparatus of claim 27, wherein the slurry comprises a silicon polish slurry, an oxide polish slurry, or a metal polish slurry.

30. The apparatus of claim 27 wherein the slurry comprises particulates having diameters in the range of 20–1000 nanometers.

31. The apparatus of claim 27 wherein the slurry comprises 1–15% particulates by weight.

32. The apparatus of claim 27, wherein the slurry has a concentration of particulates at least as great as one percent by weight and the liquid has a concentration of particulates which is less than one percent by weight.

33. The apparatus of claim 27, wherein the slurry comprises a silicon polish slurry, an oxide polish slurry, or a metal polish slurry.

34. The apparatus of claim 27 wherein the slurry comprises silica, alumina, ceria, or ferric nitrate.

* * * * *

UNITED STATES PATENT AND TRADEMARK OFFICE

CERTIFICATE OF CORRECTION

PATENT NO. : 6,497,612 B2
DATED : December 24, 2002
INVENTOR(S) : Thad L. Brunelli It is certified that error appears in the above-identified patent and that said Letters Patent is hereby corrected as shown below:

Column 4,
Lines 7-8, delete “after polishing the layer” after “layer”.
Line 9, insert -- after polishing the layer -- after “and the layer”.
Line 46, delete “tie” and insert -- the --, therefor.

Column 5,
Line 29, delete “claim 24” and insert -- claim 22 --, therefor.

Signed and Sealed this

Twenty-second Day of July, 2003

JAMES E. ROGAN
*Director of the United States Patent and Trademark Office*